US008100399B1

(12) United States Patent
Willis

(10) Patent No.: US 8,100,399 B1
(45) Date of Patent: Jan. 24, 2012

(54) PAPER GUIDE SUPPORT EXTENSION ATTACHMENTS

(75) Inventor: Keith L. Willis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/941,329

(22) Filed: Nov. 8, 2010

(51) Int. Cl.
*B65H 1/00* (2006.01)

(52) U.S. Cl. ..... 271/145; 271/171

(58) Field of Classification Search ..... 271/145, 271/171
See application file for complete search history.

(56) References Cited

U.S. PATENT DOCUMENTS

| | | | | |
|---|---|---|---|---|
| 5,632,477 | A * | 5/1997 | Morinaga | 271/127 |
| 6,032,004 | A | 2/2000 | Mirabella, Jr. et al. | |
| 6,619,656 | B2 | 9/2003 | Guddanti et al. | |
| 2006/0244199 | A1 | 11/2006 | Marasco | |

FOREIGN PATENT DOCUMENTS

| | | |
|---|---|---|
| JP | 60242138 | 12/1985 |
| JP | 9156778 | 6/1997 |
| JP | 2002205829 | 7/2002 |
| JP | 2004182471 | 7/2004 |

* cited by examiner

*Primary Examiner* — David H Bollinger
(74) *Attorney, Agent, or Firm* — Gibb I.P. Law Firm, LLC

(57) ABSTRACT

A printing device has at least one printing engine, at least one media path adjacent the printing engine, and a paper tray adjacent the media path. The paper tray stores media and supplies the media to the media path. Further, at least one sheet guide is attached to the paper tray, and at least one rectangular member is attached to the sheet guide. The rectangular member has a sheet guide opening, and the sheet guide opening attaches to the sheet guide. The rectangular member has a first planar surface that is coplanar with a second planar surface of the sheet guide. Also, the first planar surface is at least twice the two-dimensional size of the second planar surface. The first planar surface and the second planar surface contact media stored within the paper tray.

20 Claims, 5 Drawing Sheets

PAPER GUIDE SUPPORT EXTENSION ATTACHMENTS

BACKGROUND

Embodiments herein generally relate to printing devices and their associated components and more particularly to rectangular members that attached to paper guide supports within paper trays of such printing devices.

As printing devices have evolved, their capabilities have become greater and their ability to process larger sheet volumes and different size and different thickness sheets provide substantial advantages to the users. However, as more and more sheets are stacked within paper trays, and as different thickness and different sized sheets are maintained within an individual paper tray, the chances of the paper tray inappropriately maintaining the stacks of sheets dramatically increase.

For example, many paper trays include movable guides that are maintained on tracks or rails that are adjustable by the user. That is, when a user changes the size of paper being maintained within the paper tray, they can easily move the movable guides to support many different sizes of paper. However, in order to accommodate many different sizes of paper, such movable paper guides may only contact a small portion of the stack of sheets. More specifically, the movable paper guides generally have a size equal to the smallest sheets of media that can be maintained within the paper tray. These movable sheet guides are moved away from one another to handle larger sized media sheets and therefore do not contact the full length of such larger media sheets.

This difference between the size of the movable paper guides and the size of the sheets within the paper tray often allows the stack of media within the paper tray to become misaligned. For example, if the paper tray is closed with sufficient force, the momentum of the paper can cause the stack to become misaligned. This situation is especially true with taller stacks, and heavier stock media sheets. In such situations, the misalignment of the media within the paper tray can result in mis-feeds and/or paper jams.

SUMMARY

With sheet support embodiments herein, a rectangular member has a sheet guide opening, and the sheet guide opening attaches to a sheet guide. The sheet guide is attached to a paper tray. The rectangular member is temporarily attached to the sheet guide, and the sheet guide is permanently attached to the paper tray.

The rectangular member has a first planar surface that is coplanar with a second planar surface of the sheet guide. Also, the first planar surface is at least twice the two-dimensional size of the second planar surface. The first planar surface and the second planar surface contact media stored within the paper tray and the first planar surface contacts more of the media stored within the paper tray relative to the amount the second planar surface contacts the media stored within the paper tray.

The ends of the rectangular member are perpendicular to the first planar surface, and the ends contact walls of the paper tray. Additionally, the bottom surface of the rectangle member is perpendicular to the first planar surface, and the bottom surface contacts the paper tray.

In other sheet support embodiments herein, a rectangular member has a sheet guide opening, and the sheet guide opening attaches to a sheet guide. The sheet guide is attached to a paper tray. The rectangular member is temporarily attached to the sheet guide, and the sheet guide is permanently attached to the paper tray. The rectangular member also has slots connecting to walls of the paper tray.

The rectangular member has a first planar surface that is coplanar with a second planar surface of the sheet guide. Also, the first planar surface is at least twice the two-dimensional size of the second planar surface. The first planar surface and the second planar surface contact media stored within the paper tray and the first planar surface contacts more of the media stored within the paper tray relative to the amount the second planar surface contacts the media stored within the paper tray.

The ends of the rectangular member are perpendicular to the first planar surface, and the ends contact walls of the paper tray. Additionally, the bottom surface of the rectangle member is perpendicular to the first planar surface, and the bottom surface contacts the paper tray.

In additional sheet support embodiments herein, a rectangular member has a sheet guide opening, and the sheet guide opening attaches to a sheet guide. The sheet guide is attached to a paper tray. The rectangular member is temporarily attached to the sheet guide, and the sheet guide is permanently attached to the paper tray.

The rectangular member also has a backside opposite the first planar surface. The backside comprises an elongated support member protruding from the backside that contacts the paper tray. The rectangular member has a first thickness between the first planar surface and the backside, and the elongated support member has a second thickness greater than the first thickness.

The rectangular member has a first planar surface that is coplanar with a second planar surface of the sheet guide. Also, the first planar surface is at least twice the two-dimensional size of the second planar surface. The first planar surface and the second planar surface contact media stored within the paper tray and the first planar surface contacts more of the media stored within the paper tray relative to the amount the second planar surface contacts the media stored within the paper tray.

The ends of the rectangular member are perpendicular to the first planar surface, and the ends contact walls of the paper tray. Additionally, the bottom surface of the rectangle member is perpendicular to the first planar surface, and the bottom surface contacts the paper tray.

A printing device embodiment herein comprises at least one printing engine, at least one media path adjacent the printing engine, and a paper tray adjacent the media path. The paper tray stores media and supplies the media to the media path. Further, at least one sheet guide is attached to the paper tray, and at least one rectangular member is attached to the sheet guide. The rectangular member is temporarily attached to the sheet guide, and the sheet guide is permanently attached to the paper tray.

The rectangular member has a sheet guide opening, and the sheet guide opening attaches to the sheet guide. The rectangular member has a first planar surface that is coplanar with a second planar surface of the sheet guide. Also, the first planar surface is at least twice the two-dimensional size of the second planar surface. The first planar surface and the second planar surface contact media stored within the paper tray and the first planar surface contacts more of the media stored within the paper tray relative to the amount the second planar surface contacts the media stored within the paper tray.

The ends of the rectangular member are perpendicular to the first planar surface, and the ends contact walls of the paper tray. Additionally, the bottom surface of the rectangle member is perpendicular to the first planar surface, and the bottom surface contacts the paper tray.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, movable paper guides within paper trays of printing devices generally have a size equal to the smallest sheets of media that can be maintained within the paper tray. This difference between the size of the movable paper guides and the size of the sheets within the paper tray often allows the stack of media within the paper tray to become misaligned. In order to address this situation, the embodiments herein provide rectangular members that act as extensions to the movable paper guides. These rectangle members can temporarily or permanently attach to the movable paper guides.

The rectangular members presented herein more than double the two-dimensional planar surface area contacting the stack of sheets within the paper tray and, therefore, dramatically increase the consistency with which the stacks of media are maintained within the paper tray. Thus, the embodiments herein avoid the paper jam and mis-feed problems that occur when stacks of media within paper trays become misaligned.

Because of the rectangular members described herein can be larger than some movable paper guides, they may not be useful with all paper size (such as smaller paper sizes) and their application may be limited to larger sized sheets. However, once a user selects a specific paper size for a specific paper tray, users rarely change the paper size adjustment, and the rectangular members described herein could be left in place for such users.

Also, the relatively smaller sized sheets (that may not be accommodated by the rectangular members described herein) often do not exhibit the misalignment characteristics that are associated with larger sized sheets. Thus, the rectangular members described herein man not be needed for such smaller sheet sizes. Additionally, because the rectangular members herein are easily detached and reattached to the movable paper guides, whenever a user needs to adjust the movable paper guides to a smaller setting, the rectangle members described herein can easily be removed from the movable paper guides (and reattached to the movable paper guides when the larger sized sheets are used once again).

Figure 1:
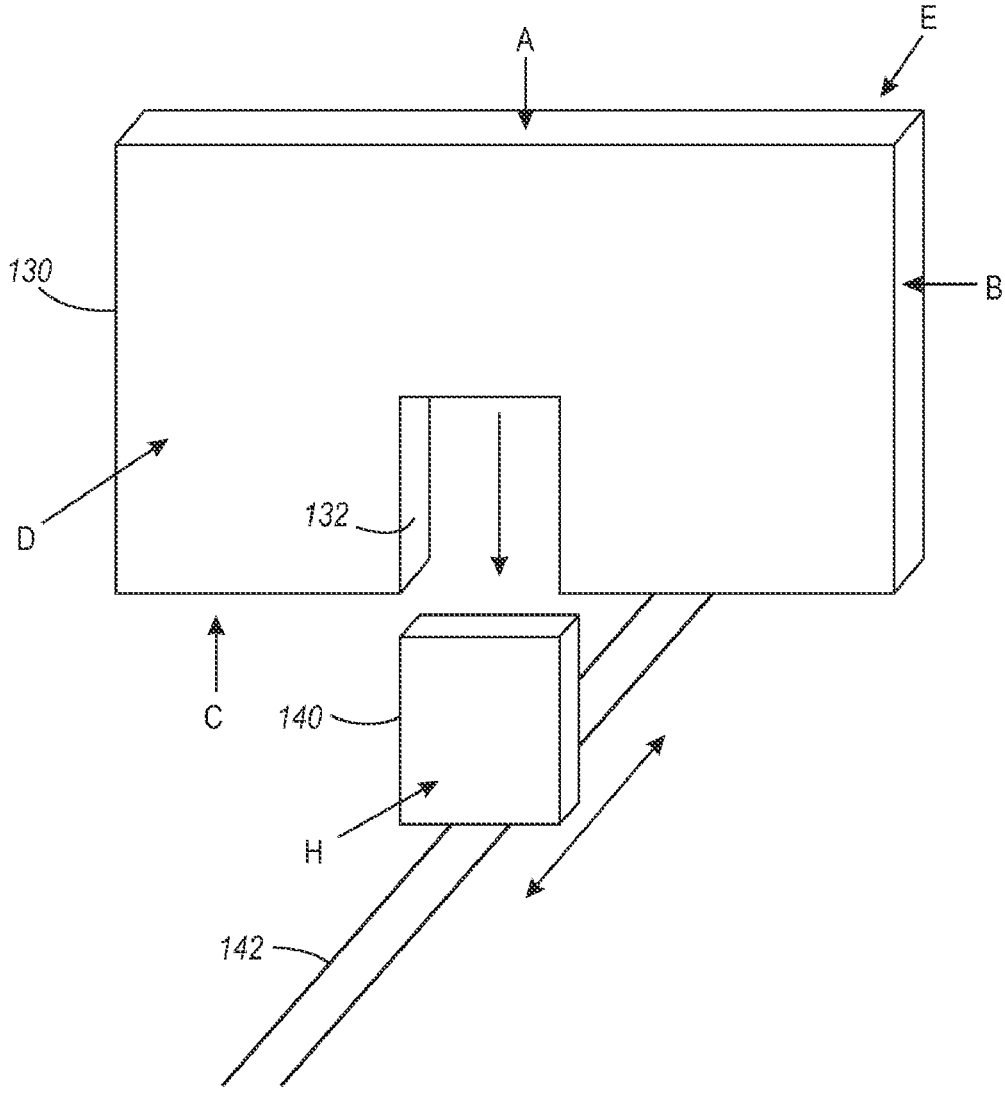
FIG. 1 is a perspective-view schematic diagram of a device according to embodiments herein.

Therefore, as shown in perspective view in FIG. 1, the embodiments herein provide a rectangular member 130 that has a movable sheet guide opening 132. As shown by the downward arrow in FIG. 1 the rectangular member 130 connects to a movable sheet guide 140 when the movable sheet guide opening 132 attaches to the movable sheet guide 140. The movable sheet guide is mounted on rails or tracks 142 and is adjustable along the rails 142, as shown by the double-headed arrow in FIG. 1.

The movable sheet guide 140 is permanently attached to a paper tray 150 (shown in FIG. 4) by way of the tracks 142. However, the rectangular member 130 is temporarily attached to the movable sheet guide 140 and is easily removed from the movable sheet guide 140. As would be understood by those ordinarily skilled in the art, the movable sheet guide opening 132 can include grooves, slots, raised edges, etc., to allow the rectangular member 130 to more easily slide on (and stay on) the movable sheet guide opening 132.

Figure 2:
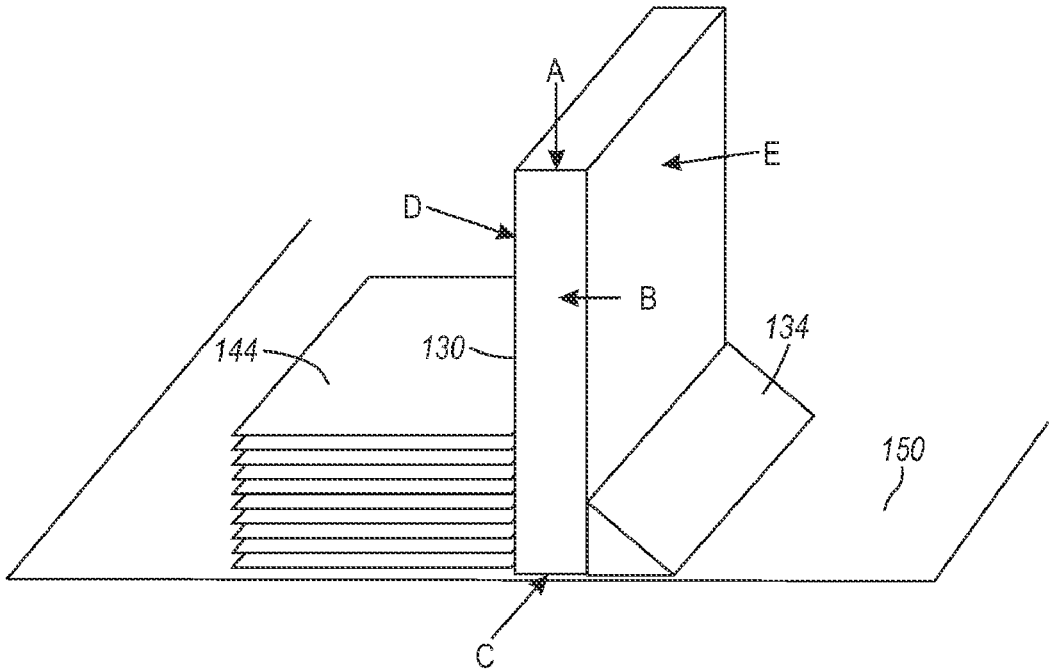
FIG. 2 is an end-view schematic diagram of a device according to embodiments herein.

As shown more clearly in the side view in FIG. 2, the rectangular member 130 also has a backside E opposite the first planar surface D. The backside E can include an elongated support 134 attached to and protruding from the backside E. The elongated support 134 contacts the paper tray 150 and keeps the rectangular member 130 from tipping over under the pressure of the stack of sheets of media 144.

The elongated support 134 can run the full width of the backside E, or a portion thereof. The rectangular member 130 has a first thickness between the first planar surface D and the backside E, and the elongated support member has a second thickness greater than or equal to the first thickness. The elongated support number 134 therefore makes the bottom or base (C) of the rectangular member 130 larger, thereby adding stability to the rectangular member 130.

Figure 3:
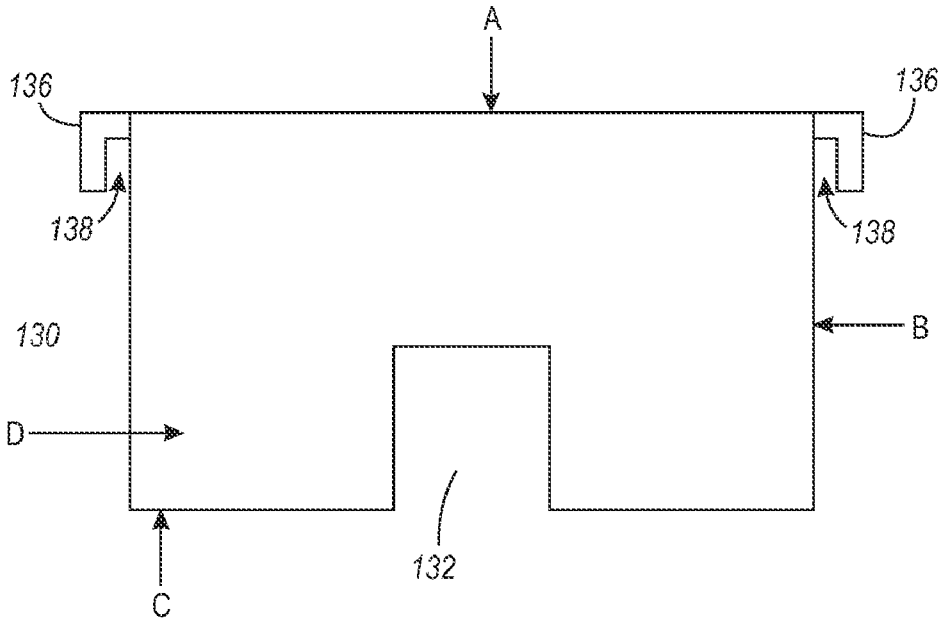
FIG. 3 is a side-view schematic diagram of a device according to embodiments herein.
Figure 4:
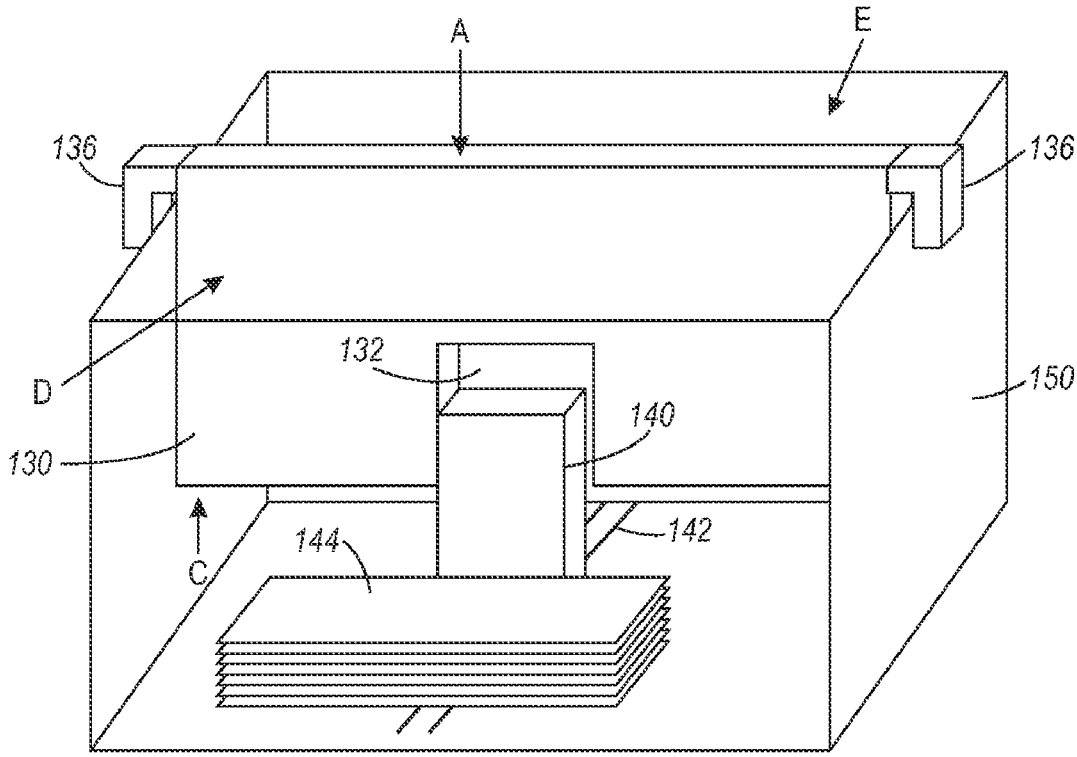
FIG. 4 is a perspective-view schematic diagram of a device according to embodiments herein.

As shown in FIGS. 3 and 4, the rectangular member 130 can also include hook projections 136 that form slots 138 connecting to walls of the paper tray 150. More specifically, FIG. 3 is a front view of the rectangular member 130 including the hook projections 136. FIG. 4 is a perspective view schematic diagram that illustrates the paper tray 150 in perspective view. The front of the paper tray 150 is shown in transparent view so that the rectangular member 130, stack of sheets 144, rails 142, movable sheet guide 140, and opening 132 can be seen through the front of the paper tray 150. As shown in FIG. 4, the slots of the hooks 136 attach to the walls of the paper tray 150.

The rectangular member 130 has a first planar surface D that is coplanar with a second planar surface H of the movable sheet guide 140 (when the rectangular member 130 is attached to the movable sheet guide 140). Also, the first planar surface D is at least twice the size (e.g., the two-dimensional size) of the second planar surface H. Thus, for example, if the second planar surface H is 10 $cm^2$ the first planar surface H is at least 20 $cm^2$ and can be much larger 30 $cm^2$, 40 $cm^2$, 50 $cm^2$, etc.

Thus, as shown in FIGS. 2 and 4, the first planar surface D and the second planar surface H contact media 144 stored within the paper tray 150. Because the first planar surface D is at least twice the two-dimensional size of the second planar surface H, the first planar surface D contacts more of the media 144 stored within the paper tray 150 relative to the amount the second planar surface H contacts the media 144 stored within the paper tray 150.

As also shown in FIG. 4, the ends B of the rectangular member 130 are perpendicular to the first planar surface D, and the ends B simultaneously contact opposing walls of the paper tray 150. Additionally, the bottom surface C of the rectangle member is perpendicular to the first planar surface D, and the bottom surface C contacts the paper tray 150.

Figure 5:
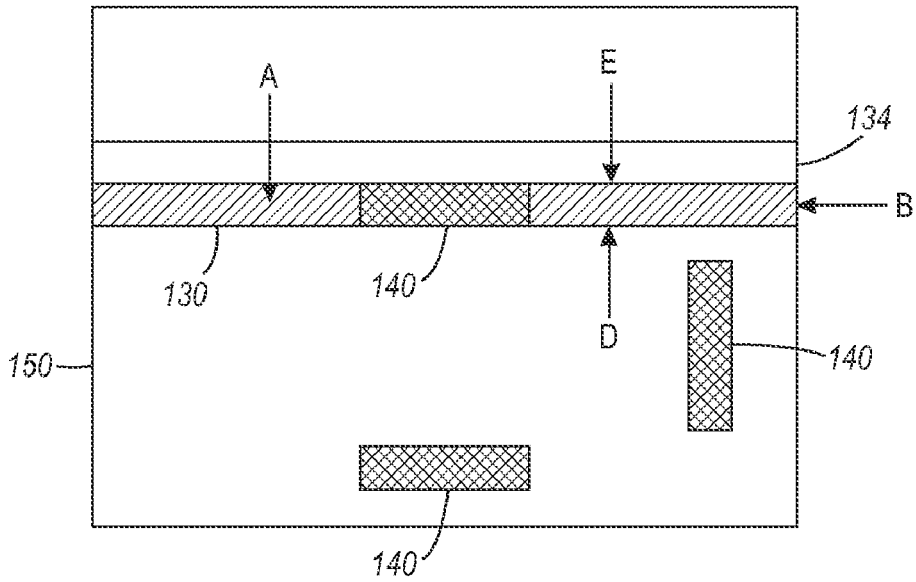
FIG. 5 is a top-view schematic diagram of a device according to embodiments herein.
Figure 6:
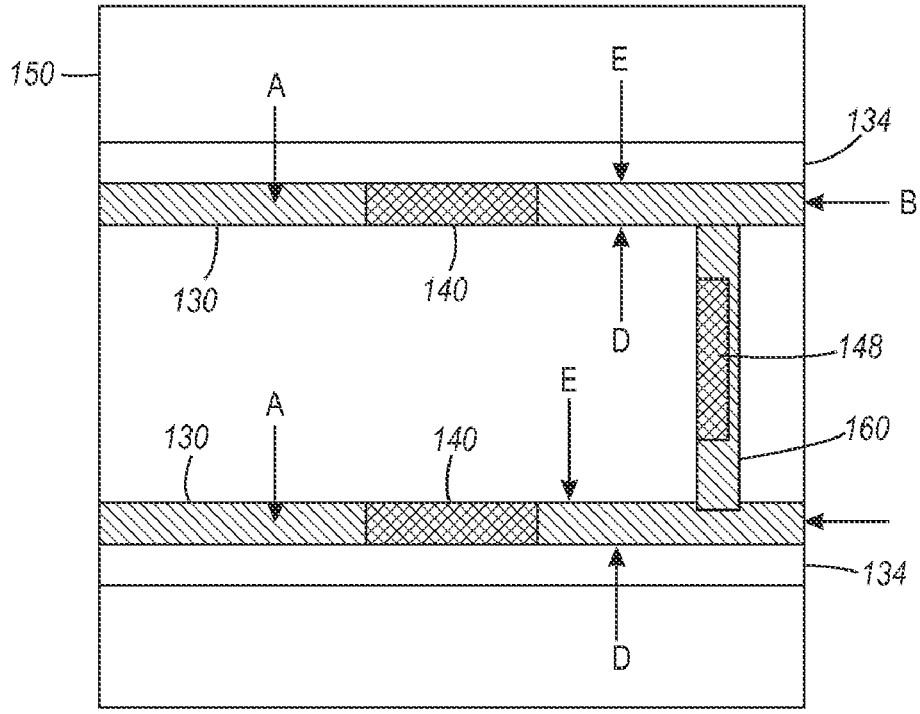
FIG. 6 is a top-view schematic diagram of a device according to embodiments herein.

FIGS. 5 and 6 are top-view diagrams looking down into the paper tray 150 from the top, which illustrate various configurations that can be accomplished with the embodiments herein. In FIG. 5, a single rectangular member 130 is attached to one of the movable sheet guides 140. In this example, the rectangular member 130 includes the projection 134, discussed above, and the rectangular member 130 reaches the sidewalls of the paper tray 150.

An alternative arrangement is shown in FIG. 6. In this arrangement, all three of the movable sheet guides 140 include a rectangular member 130. The top and bottom rectangular members 130 also include the projection 134. The movable sheet guide 148 includes a different type of rectangular member 160. This type of rectangular member 160 does not include an opening completely through the rectangle or member, but instead the opening is only formed partially through the rectangular member 160 (see also FIG. 3). Further, the rectangular member 160 only reaches between the adjacent rectangular members 130 and does not reach to the sidewalls of the paper tray 150.

FIGS. 5 and 6 illustrate two of many different configurations that can be accomplished with the embodiments herein. While not all possible configurations are illustrated in the drawings, those ordinarily skilled in the art would understand that many additional configurations are possible, depending upon specific design goals.

Figure 7:
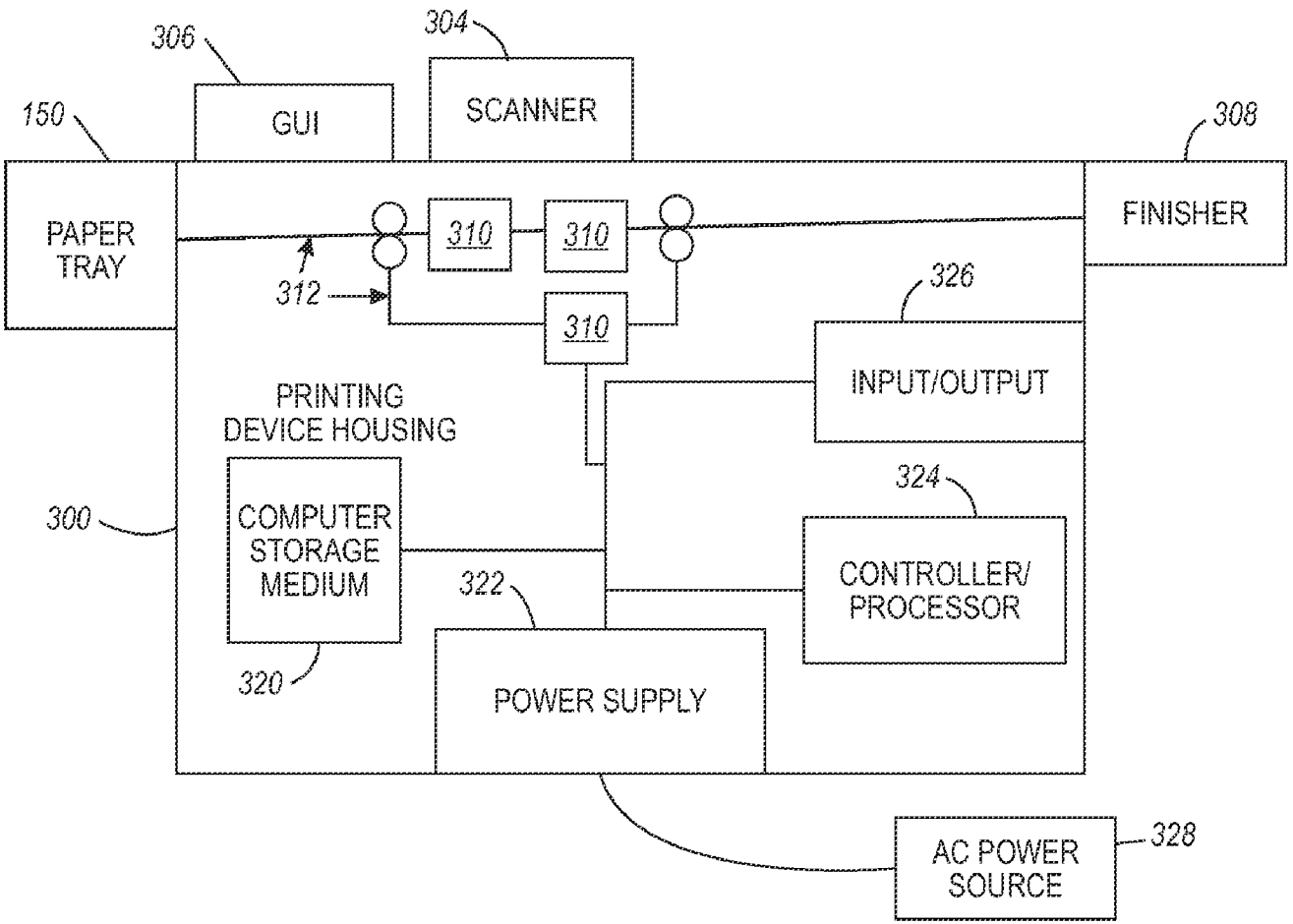
FIG. 7 is a side-view schematic diagram of a device according to embodiments herein.

FIG. 7 illustrates a printing device embodiment herein, which can comprise, for example, a printer, copier, multi-function machine, etc. The printer body housing 300 has one or more functional components that operate on power supplied from the alternating current (AC) 328 by the power supply 322. The power supply 322 converts the external power 328 into the type of power needed by the various components.

The printing device 300 includes a controller/processor 324, at least one marking device (printing engine) 310, 312, 314 operatively connected to the processor 324, a media path 312 positioned to supply sheets of media from a paper tray 150 to the marking device(s) 310 and a communications port (input/output) 326 operatively connected to the processor 324 and to a computerized network external to the printing device. After receiving various markings from the printing engine(s), the sheets of media pass to a finisher 308 which can fold, staple, sort, etc., the various printed sheets.

Further, the printing device 300 includes at least one accessory functional component (such as a scanner/document handler 304, paper tray 150, finisher 308, etc.) and graphic user interface assembly 306 that also operate on the power supplied from the external power source 328 (through the power supply 322).

The processor 324 controls the various actions of the printing device. A computer storage medium 320 (which can be optical, magnetic, capacitor based, etc.) is readable by the processor 324 and stores the scanned images and instructions that the processor 324 executes to allow the multi-function printing device to perform its various functions, such as those described herein.

As mentioned above, the paper tray 150 stores media 144 and supplies the media 144 to the media path 312. Further, at least one movable sheet guide 140 is attached to the paper tray 150, and at least one rectangular member 130 is attached to the movable sheet guide 140.

Thus, as shown above, the embodiments herein provide rectangular members that act as extensions to the movable paper guides. These rectangle members can temporarily or permanently attach to the movable paper guides. The rectangular members presented herein more than double the two-dimensional planar surface area contacting the stack of sheets within the paper tray and can span between opposing walls of the paper tray and, therefore, dramatically increase the consistency with which the stacks of media are maintained within the paper tray. Thus, the embodiments herein avoid the paper jam and mis-feed problems that occur when stacks of media within paper trays become misaligned.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A sheet support apparatus comprising:

a rectangular member, said rectangular member comprising ends contacting walls of a paper tray of a printing device and further comprising a sheet guide opening between said ends, said sheet guide opening attaching to a sheet guide within said paper tray, said sheet guide being attached to said paper tray, said rectangular member having a first planar surface that is coplanar with a second planar surface of said sheet guide, said first planar surface being taller and wider than said second planar surface such that a first two-dimensional size of said first planar surface is at least twice a second two-dimensional size of said second planar surface, and said first planar surface and said second planar surface contacting media stored within said paper tray.

2. The sheet support apparatus according to claim 1, said ends being perpendicular to said first planar surface.

3. The sheet support apparatus according to claim 1, said rectangle member further comprising a bottom surface perpendicular to said first planar surface, said bottom surface contacting said paper tray.

4. The sheet support apparatus according to claim 1, said first planar surface contacting more of said media stored within said paper tray relative to the amount said second planar surface contacts said media stored within said paper tray.

5. The sheet support apparatus according to claim 1, said rectangular member being temporarily attached to said sheet guide, and said sheet guide being permanently attached to said paper tray.

6. A sheet support apparatus comprising:

a rectangular member, said rectangular member comprising a sheet guide opening, said sheet guide opening attaching to a sheet guide within a paper tray of a printing device, said sheet guide being attached to said paper tray, said rectangular member having a first planar surface that is coplanar with a second planar surface of said sheet guide, said first planar surface being taller and wider than said second planar surface such that a first two-dimensional size of said first planar surface is at least twice a second two-dimensional size of said second planar surface, said first planar surface and said second planar surface contacting media stored within said paper tray, and said rectangular member further comprising slots connecting to opposing walls of said paper tray.

7. The sheet support apparatus according to claim 6, said rectangular member further comprising ends, said ends being perpendicular to said first planar surface, and said ends contacting walls of said paper tray.

8. The sheet support apparatus according to claim 6, said rectangle member further comprising a bottom surface perpendicular to said first planar surface, said bottom surface contacting said paper tray.

9. The sheet support apparatus according to claim 6, said first planar surface contacting more of said media stored within said paper tray relative to the amount said second planar surface contacts said media stored within said paper tray.

10. The sheet support apparatus according to claim 6, said rectangular member being temporarily attached to said sheet guide, and said sheet guide being permanently attached to said paper tray.

11. A sheet support apparatus comprising:

a rectangular member, said rectangular member comprising a sheet guide opening, said sheet guide opening attaching to a sheet guide within a paper tray of a printing device, said sheet guide being attached to said paper tray, said rectangular member having a first planar surface that is coplanar with a second planar surface of said sheet guide, said first planar surface being taller and wider than said second planar surface such that a first two-dimensional size of said first planar surface is at least twice a second two-dimensional size of said second planar surface, said first planar surface and said second planar surface contacting media stored within said paper tray, said rectangular member further comprising a backside opposite said first planar surface, said backside comprising an elongated support member protruding from said backside and contacting said paper tray, and said rectangular member having a first thickness between said first planar surface and said backside, said elongated support member having a second thickness greater than said first thickness.

12. The sheet support apparatus according to claim 11, said rectangular member further comprising ends, said ends being perpendicular to said first planar surface, and said ends contacting walls of said paper tray.

13. The sheet support apparatus according to claim 11, said rectangle member further comprising a bottom surface perpendicular to said first planar surface, said bottom surface contacting said paper tray.

14. The sheet support apparatus according to claim 11, said first planar surface contacting more of said media stored within said paper tray relative to the amount said second planar surface contacts said media stored within said paper tray.

15. The sheet support apparatus according to claim 11, said rectangular member being temporarily attached to said sheet guide, and said sheet guide being permanently attached to said paper tray.

16. A printing device comprising:

at least one printing engine;

at least one media path adjacent said printing engine a paper tray adjacent said media path, said paper tray storing media and supplying said media to said media path;

at least one sheet guide attached to said paper tray; and at least one rectangular member attached to said sheet guide and having ends contacting walls of said paper tray, said rectangular member comprising a sheet guide opening between said ends, said sheet guide opening attaching to said sheet guide, said rectangular member having a first planar surface that is coplanar with a second planar surface of said sheet guide, said first planar surface being taller and wider than said second planar surface such that a first two-dimensional size of said first planar surface is at least twice a second two-dimensional size of said second planar surface, and said first planar surface and said second planar surface contacting media stored within said paper tray.

17. The printing device according to claim 16, said ends being perpendicular to said first planar surface.

18. The printing device according to claim 16, said rectangle member further comprising a bottom surface perpendicular to said first planar surface, said bottom surface contacting said paper tray.

19. The printing device according to claim 16, said first planar surface contacting more of said media stored within said paper tray relative to the amount said second planar surface contacts said media stored within said paper tray.

20. The printing device according to claim 16, said rectangular member being temporarily attached to said sheet guide, and said sheet guide being permanently attached to said paper tray.

* * * * *